US009061311B2

(12) United States Patent
Tsuchida et al.

(10) Patent No.: US 9,061,311 B2
(45) Date of Patent: Jun. 23, 2015

(54) COATING APPARATUS AND METHOD THEREOF

(71) Applicant: Panasonic Corporation, Kadoma-shi, Osaka (JP)

(72) Inventors: Shuzo Tsuchida, Nara (JP); Yoshihiro Nakamura, Osaka (JP); Akihiro Horikawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 13/773,021

(22) Filed: Feb. 21, 2013

(65) Prior Publication Data

US 2013/0224390 A1 Aug. 29, 2013

(30) Foreign Application Priority Data

Feb. 23, 2012 (JP) ..... 2012-036890

(51) Int. Cl.

| | |
|---|---|
| ***B05C 1/02*** | (2006.01) |
| ***B05D 1/28*** | (2006.01) |
| ***B05C 1/00*** | (2006.01) |
| ***B05C 1/06*** | (2006.01) |

(52) U.S. Cl.

CPC ... *B05C 1/00* (2013.01); *B05D 1/28* (2013.01); *B05C 1/02* (2013.01); *B05C 1/025* (2013.01); *B05C 1/06* (2013.01)

(58) Field of Classification Search

None

See application file for complete search history.

(56) References Cited

U.S. PATENT DOCUMENTS

| | | | | |
|---|---|---|---|---|
| 3,786,736 | A | 1/1974 | Neeb et al. | |
| 5,625,856 | A | 4/1997 | Kohda et al. | |
| 6,129,978 | A | 10/2000 | Caldwell | |
| 2001/0017102 | A1 * | 8/2001 | Caldwell | 118/33 |
| 2004/0221803 | A1 | 11/2004 | Eisen et al. | |
| 2005/0082397 | A1 | 4/2005 | Heo | |
| 2012/0258240 | A1 * | 10/2012 | Rebstock | 427/74 |

FOREIGN PATENT DOCUMENTS

| | | |
|---|---|---|
| CN | 1537678 | 10/2004 |
| CN | 1608740 | 4/2005 |
| CN | 1824393 | 8/2006 |
| JP | 63-039357 | 2/1988 |
| JP | 63-229166 | 9/1988 |
| JP | 09-047703 | 2/1997 |
| JP | 2003-260398 | 9/2003 |
| JP | 2004-298869 | 10/2004 |

OTHER PUBLICATIONS

Chinese Office Action, Feb. 28, 2015; Chinese Application No. 201310021435.X together with English translation of Search Report (9 pages).

* cited by examiner

*Primary Examiner* — Dah-Wei D Yuan
*Assistant Examiner* — Jethro M Pence
(74) *Attorney, Agent, or Firm* — Hamre, Schumann, Mueller & Larson, P.C.

(57) ABSTRACT

In a coating apparatus and a method thereof according to the present invention, the coating-solution receiving region of a porous material 2 is smaller in bubble diameter than the contact region of a porous material 3 with a substrate 7. Thus, even if the substrate 7 is curved or wavy, a coating film 8 can be easily and evenly applied to the substrate 7.

8 Claims, 8 Drawing Sheets

COATING APPARATUS AND METHOD THEREOF

FIELD OF THE INVENTION

The present invention relates to a coating apparatus and a method thereof.

BACKGROUND OF THE INVENTION

In known coating techniques, an antireflective coating and a wavelength tunable film for interrupting specific wavelength light are applied over a wide area for solar cells, display panels, and lighting apparatuses.

For example, a die coating method is disclosed in Japanese Patent Laid-Open No. 2003-260398. FIG. 13 is a schematic diagram for explaining the conventional die coating method. When a functional film is applied to a substrate 113, a coating solution 112 is applied onto the substrate 113 from a die 111 extended in a coating width direction, through a slit formed along the length of the die 111.

In some cases, a coating solution is applied to a substrate through a porous material soaked with the coating solution. For example, coating apparatuses and coating methods described in Japanese Patent Laid-Open No. 63-229166 and Japanese Patent Laid-Open No. 63-39357 are known.

FIG. 14 illustrates the structure of the coating apparatus disclosed in Japanese Patent Laid-Open No. 63-229166. The coating apparatus causes a coating solution 115 supplied from a dispenser to penetrate into a porous material 116 and then presses the porous material 116 onto a chip 117, deforming the porous material 116 so as to press the coating solution 115 out of the porous material 116. Thus, the coating solution 115 is applied onto the chip 117.

FIG. 15 is an explanatory drawing illustrating a printing method of a printer disclosed in Japanese Patent Laid-Open No. 63-39357. The coating apparatus includes a porous material having a two-layer structure composed of an upper porous material 118 and a lower porous material 119. The bubble diameter of the upper porous material 118 is larger than that of the lower porous material 119. The upper porous material 118 is soaked with a coating solution beforehand, and then the solution is transferred from the upper porous material 118 to the lower porous material 119. The lower porous material 119 is then pressed to the substrate 113 to print the coating solution 112.

DISCLOSURE OF THE INVENTION

In a conventional die coating method, generally, a coating GAP distance, which is a clearance between a die end and a substrate, needs to be kept at several tens μm to about 300 μm to evenly apply a coating. However, for example, a cover glass substrate used for a solar cell has asymmetric surfaces that may be strengthened by rapid cooling, causing an extremely large curve or wave of 0.1 mm to several mm on the substrate. Thus, unfortunately, it is substantially impossible to keep the coating GAP distance in the die coating method.

In the method of applying the coating solution to the substrate through the porous material, it is difficult to uniformly apply the coating solution widely in the width direction with high accuracy. Thus, it is unfortunately difficult to continuously apply the coating solution over a large substrate.

An object of the present invention is to easily apply a uniform film to a curved or wavy substrate.

DESCRIPTION OF THE EMBODIMENTS

Figure 1:
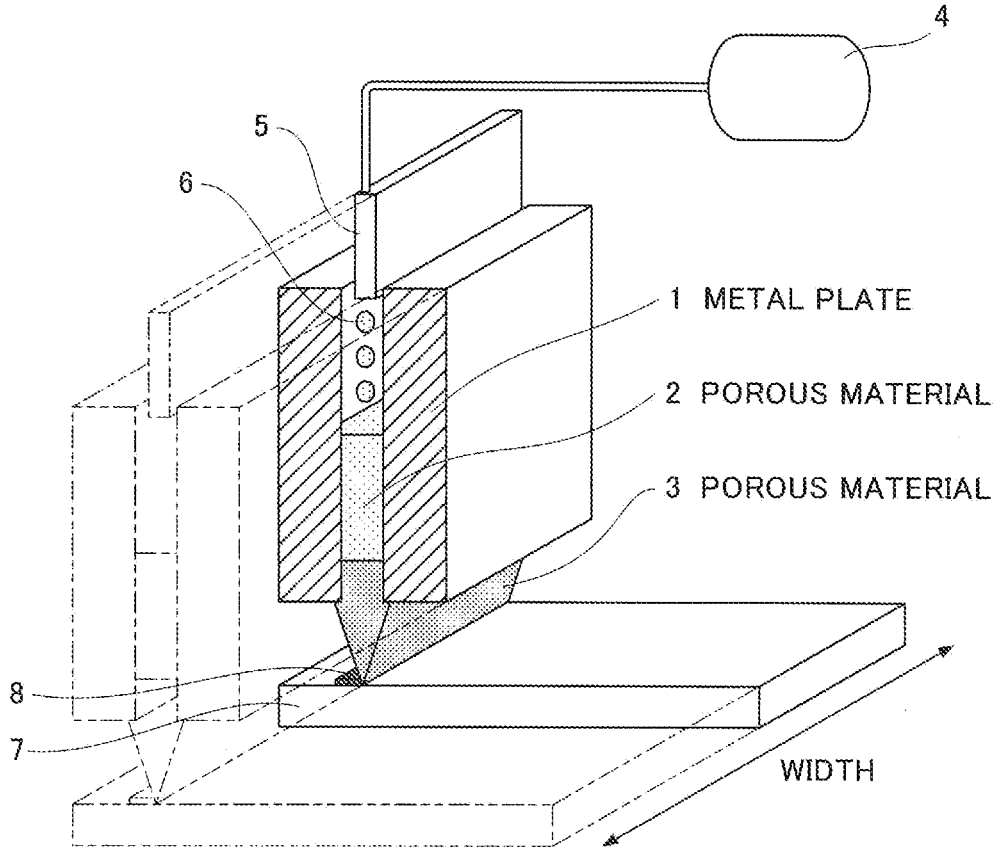
FIG. 1 is a schematic diagram illustrating the basic configuration of a coating apparatus according to the present invention.

Referring to FIG. 1, the configuration of a coating apparatus according to the present invention will be described below.

FIG. 1 is a schematic diagram illustrating the basic configuration of the coating apparatus according to the present invention. FIG. 1 is also a perspective view for visualizing a cross section. The coating apparatus according to the present invention has a minimum basic configuration including a liquid supply mechanism that accurately supplies a fixed volume of a coating solution, a liquid discharge mechanism that supplies a coating solution to a porous material, and porous materials located near the liquid supply mechanism.

A feature of the coating apparatus according to the present invention will be specifically described below. The coating apparatus according to the present invention includes two metal plates 1, each of which has a width equal to or larger than a coating width and is made of SUS, Al, and so on. A porous material 2 is interposed between the metal plates 1, and a porous material 3 is provided under the porous material 2.

A coating solution 6 is supplied to a liquid supply nozzle 5 by a pump 4 with a predetermined speed, and then the coating solution 6 is supplied to the top surface of the porous material 2 between the two metal plates 1 through the liquid supply nozzle 5. The coating solution 6 supplied to the porous material 2 penetrates the porous material 3 provided between a substrate 7 and the porous material 2. The porous material 3 in contact with the substrate 7 forms a coating film 8 on the substrate 7. The porous material has a two-layer structure composed of the porous materials 2 and 3. The porous material 2 is located near the liquid supply nozzle 5 while the porous material 3 is located in contact with the substrate 7.

For example, the porous material in Japanese Patent Laid-Open No. 63-39357 includes the upper porous material that retains a coating solution. The coating solution is supplied to the lower porous material in contact with the substrate. Hence, the bubble diameter of the upper porous material is larger than that of the lower porous material. In contrast, a feature of the coating apparatus according to the present invention is that the bubble diameter of the porous material 2 is smaller than that of the porous material 3.

Since the bubble diameter of the porous material 2 is smaller than that of the porous material 3, a capillary force is increased in a width direction so as to cause the coating solution 6 to sufficiently penetrate into the porous material 2 in the width direction. The coating solution 6 can be evenly supplied into the porous material 2 in the width direction by this phenomenon, thereby applying a coating over a large substrate. A method of changing the bubble diameters of the porous materials 2 and 3 is not particularly limited. For example, the porous materials 2 and 3 may be porous materials made of the same material with different foaming degrees or porous materials made of different materials with different foaming degrees.

In the case where porous materials formed with varying bubble diameters are attached into the coating apparatus, the metal plates 1 are not particularly necessary. The porous materials may be held by any member. The porous materials 2 and 3 made of the same material with the same foaming degree may be varied in bubble diameter by changing a degree of compression (amount of deformation) between the metal plates 1.

The used porous materials 2 and 3 need to be selected materials that continuously foam and have resistance to a used coating solution. Moreover, the porous material 3 in contact with the substrate 7 desirably has high abrasion resistance. The liquid supply nozzle 5 preferably supplies a coating solution uniformly in the coating width direction of the porous material 2. For example, the coating solution is desirably supplied to the porous material 2 by using the liquid supply nozzle 5 that has multiple liquid outlet ports separately arranged in the coating width direction. An additional mechanism for swinging the liquid supply nozzle 5 in the coating width direction is also effective. The liquid outlet port may be a long slit extended in the coating width direction.

Since the porous material 3 containing air bubbles is applied in contact with a coating surface, the porous material in contact with the substrate 7 is deformed with air bubbles to absorb waves or the like on the substrate 7, thereby keeping a constant GAP distance. Accordingly, the bubble diameter of the porous material 2 is smaller than that of the porous material 3, allowing the coating solution 6 supplied into the porous material 2 to spread over the porous material 2 before reaching the porous material 3. Thus, the coating solution 6 is evenly supplied in the width direction of the porous material so as to easily apply a uniform coating. Particularly, a thin film of the order of sub microns can be evenly applied with ease.

The porous material 3 serving as an end portion has a large bubble diameter and thus can retain the coating solution 6 while suppressing dripping of the coating solution.

Referring to FIG. 1, the steps of applying a thin film to the substrate 7 will be described below.

The contents of preparation prior to coating application to the substrate 7 will be first described below. For example, the coating solution 6 is transferred to the liquid supply nozzle 5 by the pump 4, e.g., a tube pump or a CT pump that can stably discharge a fixed volume, and then the coating solution 6 is supplied in a continuous and regular manner or in an intermittent manner from the liquid supply nozzle 5 to the top surface of the porous material 2 interposed between the two metal plates 1. The supplied coating solution 6 spreads in the coating width direction while penetrating the porous material 2 downward (to the porous material 3 in FIG. 1). In this case, the porous materials 2 and 3 varied in bubble diameter considerably affect the ease of spread in the width direction, which will be specifically described later.

The coating solution 6 having spread over the porous material 2 in the width direction gradually penetrates the porous material 3 and then spreads over the porous material 3. In the case where the coating solution 6 exceeds a maximum permissible volume retainable by the porous material 3, dripping may occur. Thus, the supply of the coating solution 6 from the liquid supply nozzle 5 is stopped immediately before the coating solution 6 exceeds the maximum liquid volume.

A method of applying the coating solution 6 to the substrate 7 will be described below. The substrate 7 is transported near the end of the porous material 3, and then the substrate 7 or a head unit (indicating an overall unit including the porous materials 2 and 3 and the metal plates 1 holding the porous materials 2 and 3) is moved in a direction that brings the substrate 7 and the head unit relatively close to each other, allowing the end of the porous material 3 to come into contact with the substrate 7. One of the substrate 7 and the head unit in contact with each other is moved relatively in a lateral direction, thereby applying the coating solution 6 from the porous material 3 onto the substrate 7.

In the case where the amount of deformation on the end of the porous material 3 is equal to or larger than the amount of curving or waving of the substrate 7, even if the end of the porous material 3 is deformed to cause the substrate 7 to be curved or wavy, the coating solution 6 can be basically applied over the substrate 7. However, in reality, the amount of deformation on the end of the porous material 3 is desirably at least twice the amount of curving or waving of the substrate 7 in consideration of uniform coating-film thickness distribution.

Embodiments will be specifically described below with reference to the accompanying drawings.

First Embodiment

For example, in a coating apparatus according to the present invention, porous materials 2 and 3 are foamed resins (melamine foam or urethane foam), the porous material 3 has a bubble diameter of about 50 μm to 200 μm, the porous material 2 has a bubble diameter of about 1 μm to 50 μm, and a usable coating solution contains IPA and ethanol as principal components with several to several tens mPa·s.

Referring to FIGS. 2A to 2F, the states of the coating solution applied by the coating apparatus according to the present invention will be first described below. FIGS. 2A to 2F illustrate the states of penetration of the coating solution according to the first embodiment.

Figure 2A:
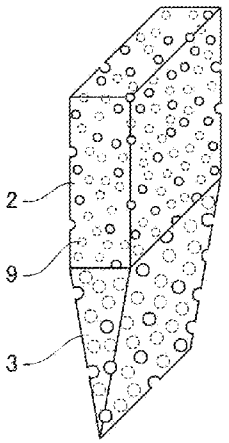
FIG. 2A illustrates the penetration of a coating solution according to a first embodiment.
Figure 2B:
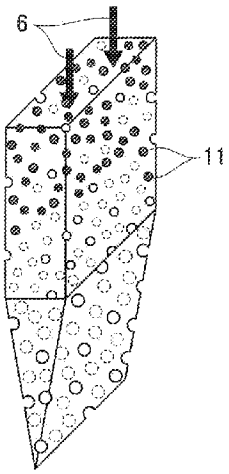
FIG. 2B illustrates the penetration of the coating solution according to the first embodiment.

In the coating apparatus of the present embodiment, as illustrated in FIG. 2A, the porous materials 2 and 3 contain air bubbles 9 of varying bubble diameters. When a coating solution 6 is applied, as illustrated in FIG. 2B, the coating solution 6 is first supplied onto the top surface of the porous material 2 and penetrates the air bubbles 9 of the porous material 2, and then the coating solution filling the air bubbles 9 causes a liquid pool 11. The coating solution 6 is further supplied so as to spread in the coating width direction of the porous material 2 before reaching the porous material 3. The coating solution 6 can be spread in the coating width direction of the porous material 2 by a phenomenon (capillarity) of a capillary force facilitating the spread of the solution to the porous material 2 that is smaller in bubble diameter than the porous material 3. Thus, the coating solution 6 can be evenly supplied in the width direction of the porous material 3.

Figure 2C:
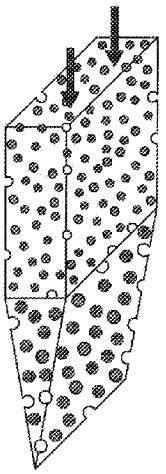
FIG. 2C illustrates the penetration of the coating solution according to the first embodiment.

The coating solution 6 is then further supplied and exceeds a fluid volume limit retainable by the air bubbles 9 of the porous material 2. At this point, as illustrated in FIG. 2C, the coating solution 6 gradually spreads over the porous material 3. Hence, the coating solution 6 can be evenly supplied in the width direction of the porous material 3 and can be evenly applied in the width direction of the substrate.

Figure 2D:
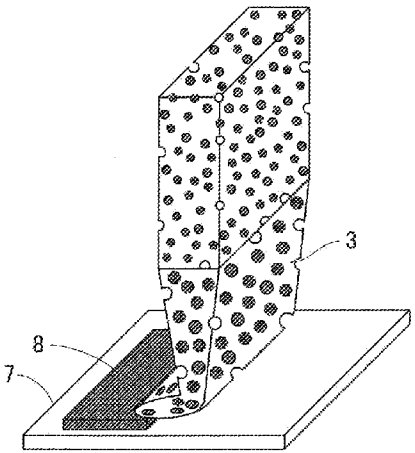
FIG. 2D illustrates the penetration of the coating solution according to the first embodiment.
Figure 2E:
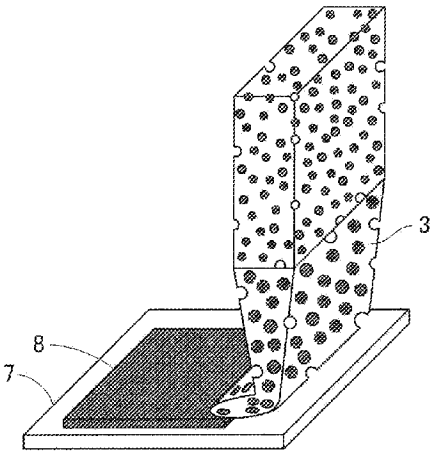
FIG. 2E illustrates the penetration of the coating solution according to the first embodiment.
Figure 2F:
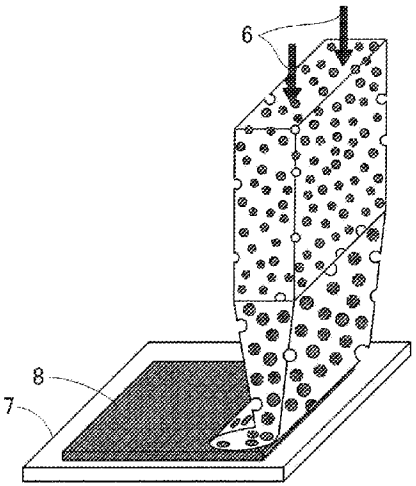
FIG. 2F illustrates the penetration of the coating solution according to the first embodiment.

The end of the porous material 3 is then brought into contact with a substrate 7 so as to be slightly deformed as illustrated in FIG. 2D. When the end of the porous material 3 is deformed, the coating solution 6 retained in the end of the porous material 3 seeps and spreads in the coating width direction on a contact portion between the end of the porous material 3 and the substrate 7. The coating solution 6 applied linearly in the coating width direction on the substrate 7 is then placed in a stable bead condition. As illustrated in FIG. 2E, the substrate 7 or the porous material 3 relatively moves in a lateral direction while keeping the stable bead condition, thereby forming a coating film 8 on the substrate 7. At this point, the coating solution 6 evenly and stably supplied in the width direction of the porous material 3 can be evenly applied in the width direction of the substrate 7. Even in the case of a long coating distance, the coating solution 6 in the porous material 2 and the porous material 3 gradually reaches the end of the porous material 3, thereby keeping the stable bead condition. In this case, it is important to keep the balance of a liquid volume remaining as the coating film 8 on the substrate 7 and a liquid volume penetrating the end of the porous material 3 from the porous material 2. Thus, the coating solution 6 has to be continuously or intermittently supplied from the top surface of the porous material 2 during coating so as not to reduce a liquid volume from the porous materials 2 and 3 to the end of the porous material 3. At this point, the smaller the supply of the coating solution 6, the smaller the thickness of the coating film or the higher the probability of blurred printing. In contrast, the larger the amount of the supplied coating solution 6, the larger the thickness of the coating film. To address this problem, in the case where the coating film 8 formed on the substrate 7 is partially reduced in thickness or has blurred printing, the uniformity of the thickness can be improved by increasing the volume of the coating solution 6 supplied from a pump. Hence, the pump desirably has an adjustment function of changing the discharge volume of the pump during coating so as to adjust the volume of the coating solution 6 during coating. The thickness of the coating film can be controlled by the volume and coating speed (substrate traveling speed) of the supplied coating solution 6. In the case where the relative traveling speed of the substrate 7 is increased with a constant volume of the supplied coating solution 6, the coating film 8 can be reduced in thickness but unfortunately, blurred printing or air bubbles may occur. Reversely, in the case where the relative traveling speed of the substrate 7 is reduced, the coating film 8 can be increased in thickness but unfortunately, a coating tact may increase. Thus, a desirable function is to separately adjust the volume of the supplied coating solution 6, that is, the discharge speed of the pump and the relative traveling speed of the substrate 7 to set the best conditions such as the thickness, quality, and tact of the coating film 8. Finally, the thickness of the coating film is varied also by changing the ratio of the solvent to solid components (film forming components) of the coating solution and the viscosity of the coating solution. Thus, a fine adjustment to the ratio of solid components and a viscosity is also necessary. For example, the lower the viscosity of the solvent of the coating solution, the higher the conformability of the substrate 7 and the coating solution 6. Thus, the above-described blurred printing and entrained air bubbles can be reduced. The ratio of the solvent to the solid components is increased or reduced, allowing a functional film formed after drying and burning to be increased or reduced in thickness with a constant thickness of the coating film 8. Thus, the volume of the coating solution 6, the relative traveling speed of the substrate 7, and the viscosity of the solvent may be adjusted to set conditions satisfying the quality and tact of the coating film 8, and then a fine adjustment may be made to the ratio of the solvent to the solid components so as to adjust the thickness of the functional film formed after drying and burning (FIG. 2F).

In this case, the end of the porous material 3 may be wedge shaped with a cross sectional area decreasing toward the end of the porous material 3. The wedge shape of the porous material 3 allows the coating solution 6 penetrating the porous material 3 from the porous material 2 to gradually gather on the end of the porous material 3, that is, the wedge-shaped end of the porous material 3. Thus, the effect of keeping the stable bead condition is obtained. The end of the porous material 3 at this point is easily deformed so as to eliminate the influence of waves on the substrate while keeping a constant GAP distance, easily achieving uniform coating.

Second Embodiment

Figure 3A:
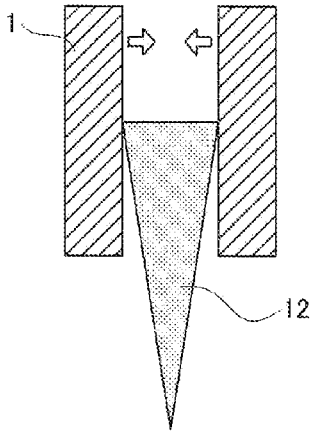
FIG. 3A illustrates a shape of a porous material according to a second embodiment.
Figure 3B:
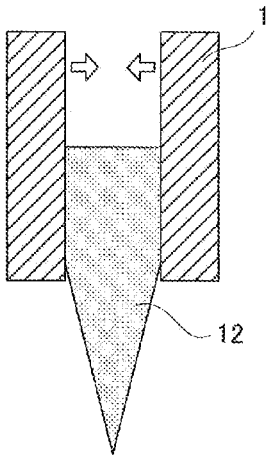
FIG. 3B illustrates a shape of the porous material according to the second embodiment.
Figure 3C:
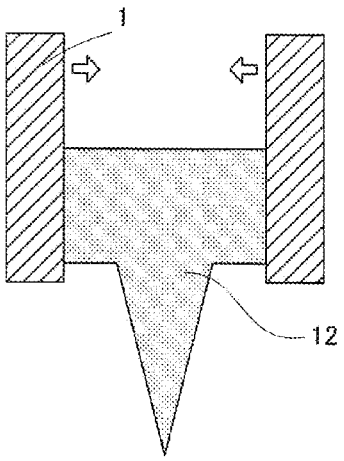
FIG. 3C illustrates a shape of the porous material according to the second embodiment.

The configuration of a porous material will be described below. As has been discussed in the first embodiment, a porous material 3 having a larger bubble diameter may be connected under a porous material 2 having a smaller bubble diameter. The porous materials 2 and 3 are different materials. Alternatively, the upper part and the lower part of a single porous material may be varied in bubble diameter. Referring to FIGS. 3A, 3B, and 3C, an example of a porous material 12 of the same material will be described below. The porous material 12 corresponds to the porous materials 2 and 3 described in the first embodiment. In this example, the upper part of the porous material 12 and a lower part including the end of the porous material 12 are varied in bubble diameter. FIGS. 3A, 3B, and 3C illustrate the shapes of the porous material according to the second embodiment, and also illustrate examples of the cross-sectional shape of the porous material interposed between the metal plates 1 illustrated in FIG. 1.

As illustrated in FIGS. 3A, 3B, and 3C, the porous material 12 is increased in thickness toward the upper end in cross section. For example, the porous material 12, which is triangle (FIG. 3A) or trapezoidal in cross section, is interposed between metal plates 1 so as to expose the lower end of the porous material 12 (FIGS. 3A to 3C). The metal plates 1 are then moved in a direction that reduces spacing between the metal plates 1, thereby applying a pressure to the porous material 12. Thus, the upper end and the lower end can be varied in the amount of compression while the upper end and the lower end of the porous material 12 can be varied in bubble diameter. In the present embodiment, only the upper end of the porous material 12 is pressed to reduce the bubble diameter of the upper part of the porous material 12 while increasing the bubble diameter of the lower part including the end of the porous material 12.

Figure 4A:
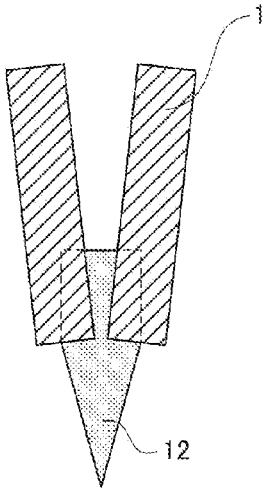
FIG. 4A illustrates the shapes of metal plates according to the second embodiment.
Figure 4B:
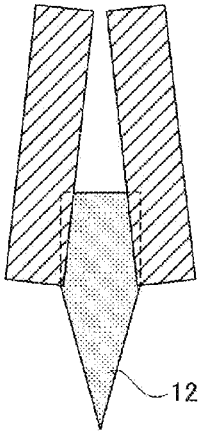
FIG. 4B illustrates the shapes of the metal plates according to the second embodiment.
Figure 4C:
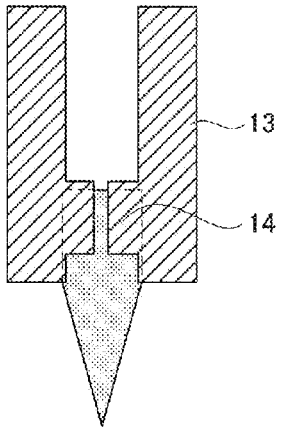
FIG. 4C illustrates the shapes of the metal plates according to the second embodiment.

FIGS. 4A, 4B, and 4C illustrate the shapes of the metal plates according to the second embodiment, that is, an example of the shapes of the metal plates holding the porous material. As illustrated in FIGS. 4A and 4B, the porous material 12 having a predetermined shape is compressed by the two metal plates 1 fixed at varying angles (FIGS. 4A to 4C), achieving the effect of changing the amount of compression. As illustrated in FIG. 4C, a projection 14 may be partially formed on a metal plate 13 to compress the porous material 12. Thus, the amount of compression can be changed (FIG. 4C) so as to vary the bubble diameter of the porous material 12. Specifically, the porous material 12 having a predetermined bubble diameter is compressed so as to deform air bubbles to have a smaller bubble diameter. Hence, a fine adjustment can be made to the bubble diameter by adjusting the amount of compression, allowing an adjustment to the coating solution spread in a width direction by capillarity described in the first embodiment.

As illustrated in FIG. 4A, a distance between the metal plates 13 decreases toward the ends of the metal plates 13 from an area receiving the coating solution. Thus, the area receiving the coating solution contains large air bubbles, allowing the upper part of the porous material 12 to retain the coating solution. Reversely, as illustrated in FIG. 4B, a distance between the metal plates 13 increases toward the ends of the metal plates 13 from the area receiving the coating solution, allowing the supplied coating solution to efficiently spread in the width direction. Moreover, as illustrated in FIG. 4C, the projections 14 provided on the metal plates 13 can more easily compress the porous material 12 in a selective manner.

Third Embodiment

Figure 5A:
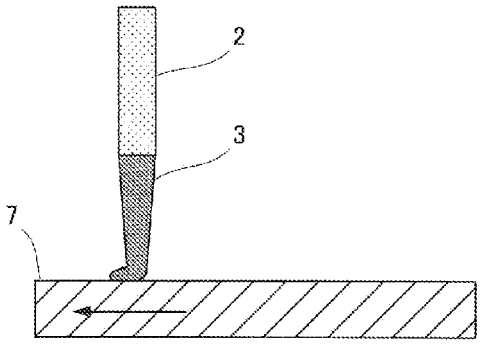
FIG. 5A is an explanatory drawing illustrating a defect when the end of a porous material is brought into contact with a substrate.
Figure 5B:
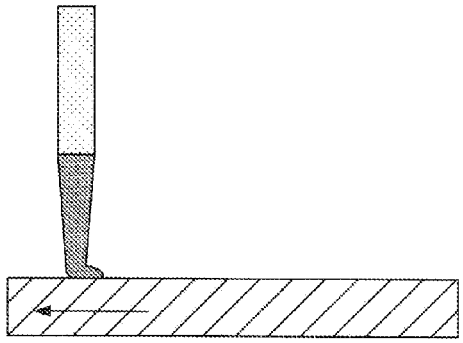
FIG. 5B is an explanatory drawing illustrating the defect when the end of the porous material is brought into contact with the substrate.

Referring to FIGS. 5A to 8C, operations of bringing the end of a porous material 3 into contact with a substrate 7 will be specifically described below. FIGS. 5A and 5B are explanatory drawings illustrating defects occurring when the end of the porous material is in contact with the substrate. Particularly, in the case where the porous material 3 has a wedge-shaped end, as illustrated in FIG. 5A, the end of the porous material 3 vertically in contact with the substrate 7 may be deformed in the traveling direction of the substrate 7 (the direction of an arrow in FIG. 5A). Alternatively, as illustrated in FIG. 5B, the end of the porous material 3 may be deformed opposite to the traveling direction of the substrate 7. The states of FIGS. 5A and 5B are locally mixed in a coating width direction. The substrate 7 in this state is transported with the porous material 3 in contact with the substrate, which may change the deforming direction of the end of the porous material 3 from the state of FIG. 5B to the state of FIG. 5A. In this case, unfortunately, a coating film may be streaked or unevenly applied so as to partially increase in thickness.

Figure 6A:
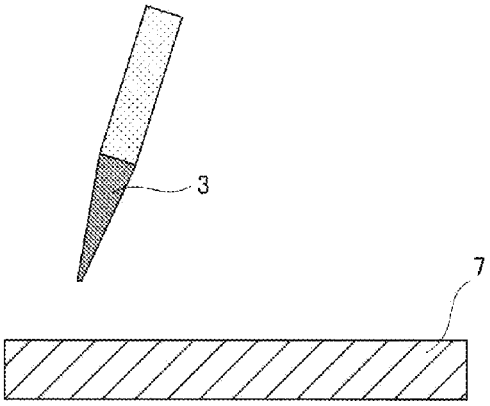
FIG. 6A illustrates a method of bringing the end of a porous material into contact with an object according to a third embodiment.
Figure 6B:
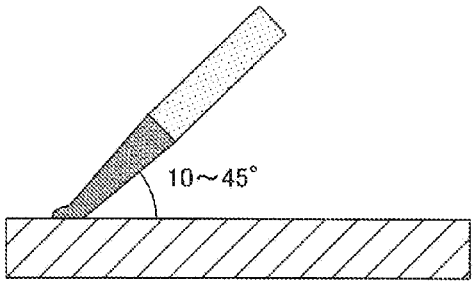
FIG. 6B illustrates the method of bringing the end of the porous material into contact with the object according to the third embodiment.

Referring to FIGS. 6A to 8C, a method of solving this problem will be described below. FIGS. 6A and 6B illustrate a method of bringing the end of the porous material into contact with an object according to a third embodiment. As illustrated in FIG. 6A, the porous material 3 is fixed to a coating apparatus (a fixing mechanism is not illustrated) while the end of the porous material 3 is inclined at about 10° to 45° opposite to the traveling direction of the substrate. The porous material 3 kept at the angle is brought into contact with the substrate 7. As illustrated in FIG. 6B, this method fixes the deforming direction of the end of the porous material 3 so as to solve the problem. The substrate 7 is moved after that.

Figure 7A:
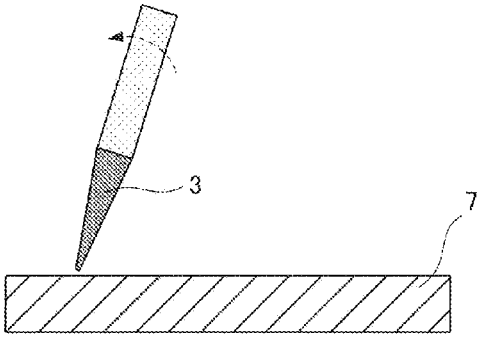
FIG. 7A illustrates a method of bringing the end of the porous material into contact with an object according to the third embodiment.
Figure 7B:
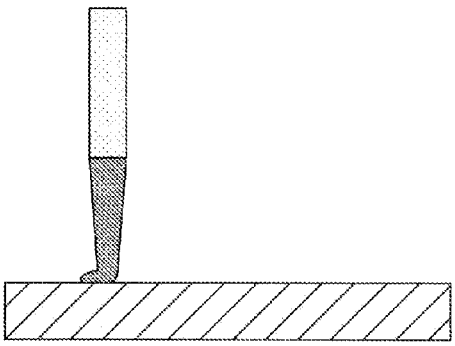
FIG. 7B illustrates the method of bringing the end of the porous material into contact with the object according to the third embodiment.

FIGS. 7A and 7B illustrate a method of bringing the end of the porous material into contact with an object according to the third embodiment. As illustrated in FIG. 7A, the porous material 3 is fixed to the coating apparatus (the fixing mechanism is not illustrated) while being inclined at about 10° to 45° opposite to the traveling direction of the substrate. The fixing mechanism may change the angle. The inclined porous material 3 is brought into contact with the substrate 7 and is raised to a predetermined angle with respect to the substrate 7, and then the substrate 7 is moved (FIG. 7B). Hence, the end of the porous material 3 can be stably deformed in the traveling direction of the substrate 7 so as to solve the problem.

Figure 8A:
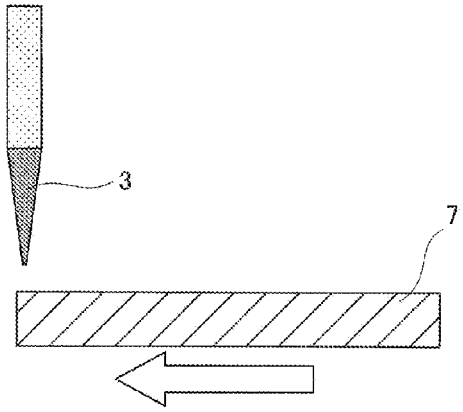
FIG. 8A illustrates a method of bringing the end of the porous material into contact with an object according to the third embodiment.
Figure 8B:
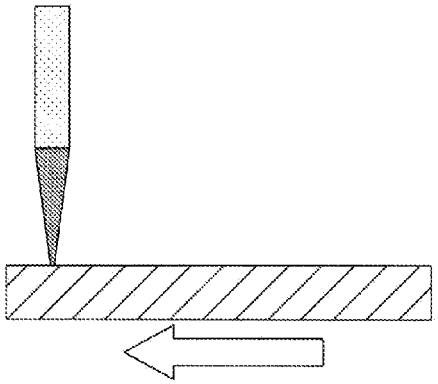
FIG. 8B illustrates the method of bringing the end of the porous material into contact with the object according to the third embodiment.
Figure 8C:
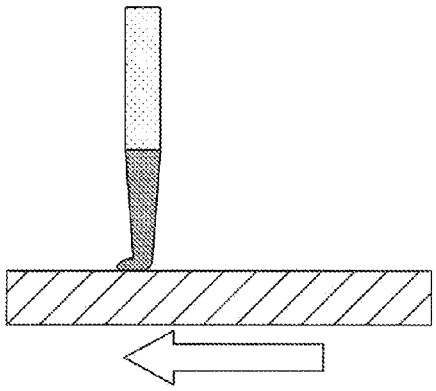
FIG. 8C illustrates the method of bringing the end of the porous material into contact with the object according to the third embodiment.

FIGS. 8A to 8C illustrate a method of bringing the end of the porous material into contact with an object according to the third embodiment. As illustrated in FIG. 8A, the substrate 7 is moved with a constant speed in the traveling direction immediately before the porous material 3 comes into contact with the substrate 7. As illustrated in FIG. 8B, the end of the porous material 3 is brought into contact with the moving substrate 7. Thus, as illustrated in FIG. 8C, the end of the porous material 3 can be stably deformed in the traveling direction of the substrate.

Fourth Embodiment

Figure 9A:
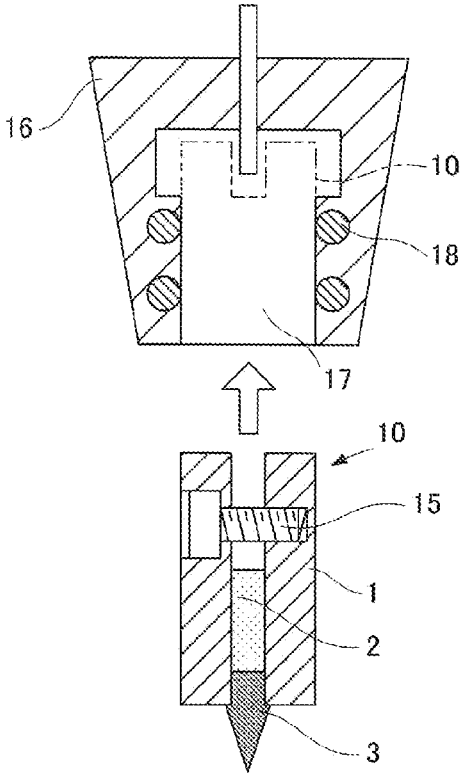
FIG. 9A illustrates the structure of a fixing mechanism for a head unit according to a fourth embodiment.
Figure 9B:
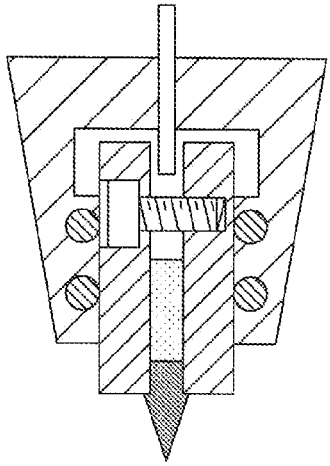
FIG. 9B illustrates the structure of the fixing mechanism for the head unit according to the fourth embodiment.
Figure 10:
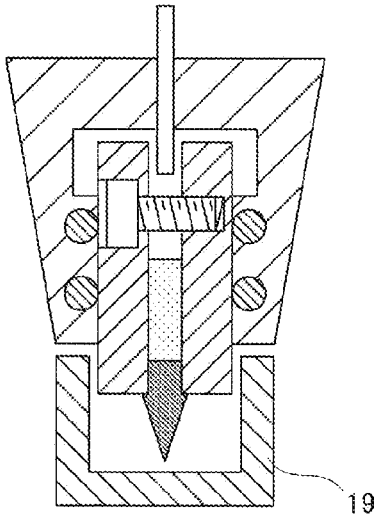
FIG. 10 illustrates the structure of a drying preventing cover on the end of a porous material according to the fourth embodiment.

Referring to FIGS. 9A, 9B, and 10, a fixing method of a head unit will be described below. FIGS. 9A and 9B illustrate the structure of a fixing mechanism for the head unit according to a fourth embodiment.

The top surface of a porous material 2 is exposed between two metal plates 1 constituting a head unit 10. Thus, a volatile coating solution applied to the top surface of the porous material 2 may evaporate from the top surface. Furthermore, continuous coating may wear or chip a porous material 3, requiring replacement of the porous materials 2 and 3 constituting the head unit 10. Hence, a structure for easy replacement is necessary.

In the formation of the head unit 10, first, as illustrated in FIG. 9A, the metal plates 1 holding the porous materials 2 and 3 are fixed with, for example, a screw 15 to preassemble the head unit 10 before coating. As illustrated in FIG. 9B, the head unit 10 is then inserted and fixed into a cavity 17 in a fixing part 16, so that the head unit 10 can be easily fixed in a closed atmosphere. Furthermore, the head unit 10 can be easily replaced with another in a short time, and drying of the coating solution from the head unit 10 can be prevented. The fixing part 16 containing press rollers 18 can position and fix the head unit 10. Moreover, the pressures of the press rollers 18 are changed so as to adjust the amount of compression of the porous material.

Since the end of the porous material 3 is always exposed, the coating solution needs to be prevented from drying from the end of the porous material 3. FIG. 10 illustrates the structure of a cover for preventing drying on the end of the porous material according to the fourth embodiment. As illustrated in FIG. 10, in a coating standby time, a mechanism for covering the end of the porous material 3 with a drying preventing cover 19 is also effective.

Fifth Embodiment

Figure 11:
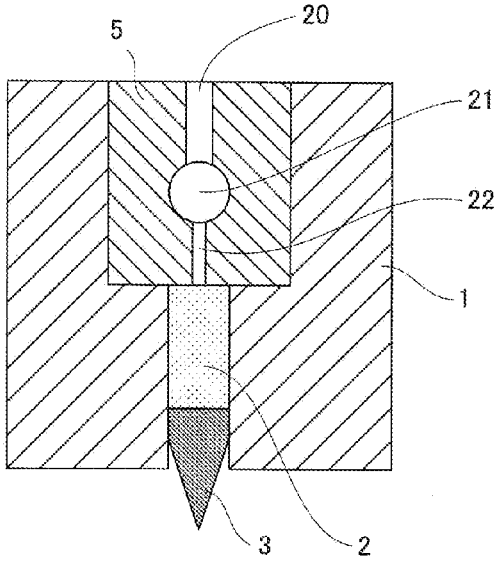
FIG. 11 illustrates a structure including a head unit and a liquid supply nozzle according to a fifth embodiment.
Figure 12A:
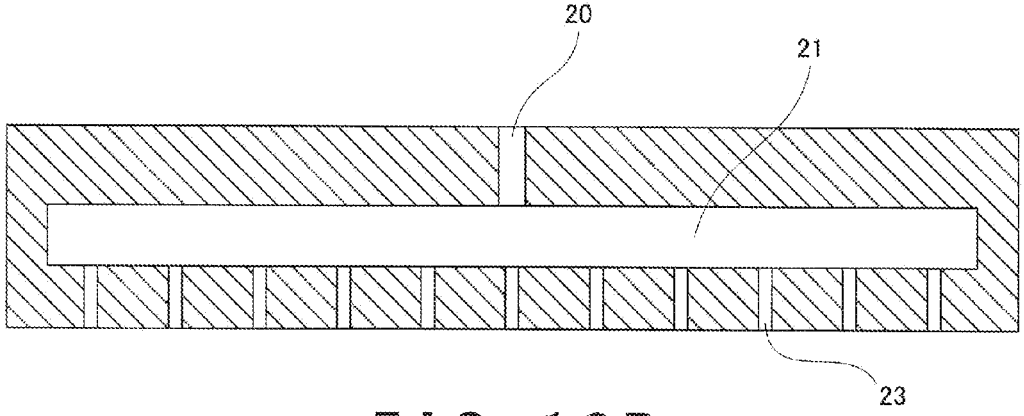
FIG. 12A illustrates a structure of the liquid supply nozzle according to the fifth embodiment.
Figure 12B:
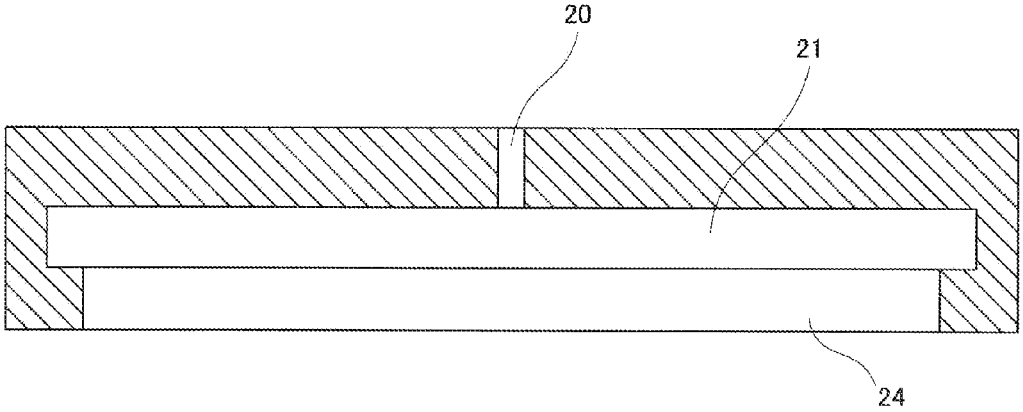
FIG. 12B illustrates a structure of the liquid supply nozzle according to the fifth embodiment.
Figure 13:
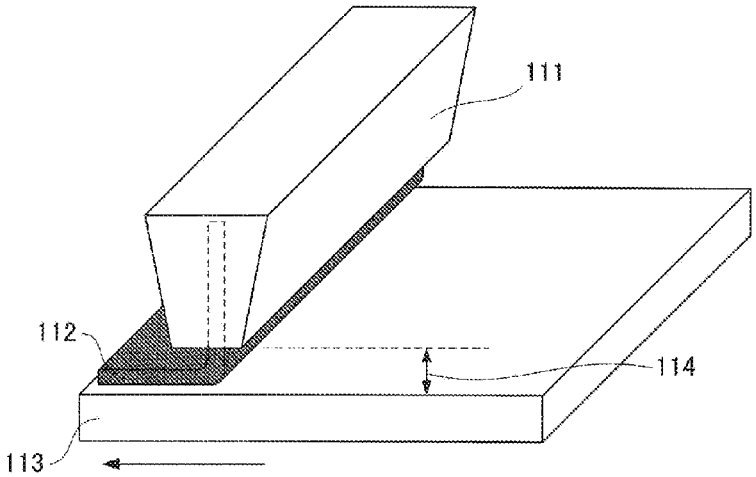
FIG. 13 PRIOR ART
FIG. 13 is a schematic diagram for explaining a conventional die coating method.
Figure 14:
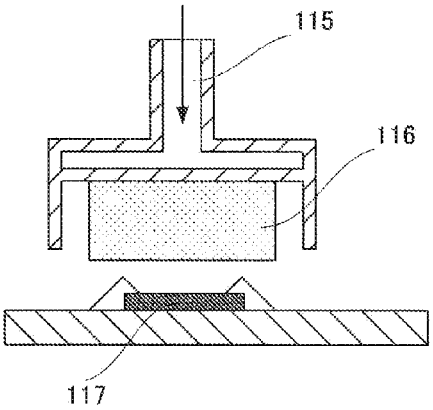
FIG. 14 PRIOR ART
FIG. 14 is a schematic diagram illustrating the structure of a coating apparatus including a conventional porous member.
Figure 15:
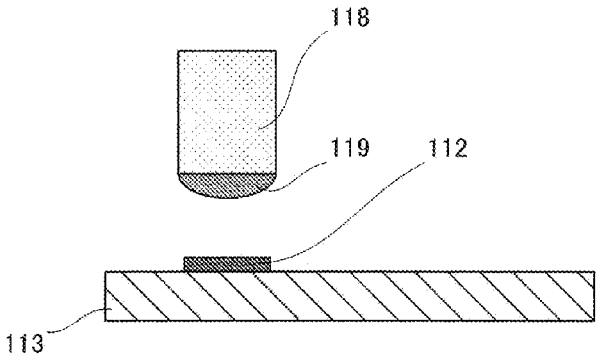
FIG. 15 PRIOR ART
FIG. 15 is a schematic diagram illustrating a coating method using a conventional porous member having a two-layer structure.

Referring to FIGS. 11, 12A, and 12B, the structures of a head unit and a liquid supply nozzle will be described below according to another embodiment.

FIG. 11 illustrates a structure including the head unit and the liquid supply nozzle according to a fifth embodiment. FIGS. 12A and 12B illustrate the structure of the liquid supply nozzle according to the fifth embodiment. FIGS. 12A and 12B are also cross-sectional views illustrating the liquid supply nozzle.

In this configuration, a porous material 2 and a porous material 3 are interposed between metal plates 1. Moreover, a liquid supply nozzle 5 is interposed between the metal plates 1. A coating solution supplied from a pump (not shown) is fed into a liquid inlet port 20 of the liquid supply nozzle 5, and then is discharged into a manifold 21, allowing the solution to spread in a coating width direction. The solution is then discharged from a liquid outlet port 22 onto the top surface of the porous material 2. The liquid outlet port 22 is desirably located substantially in contact with the top surface of the porous material 2. This is because the coating solution discharged from the liquid outlet port 22 can be stably supplied onto the top surface of the porous material 2, and drying of the solution can be prevented.

As illustrated in FIG. 12A, the liquid outlet port 22 can be provided with small holes 23 of 0.1 mm to 0.5 mm in diameter at regular intervals. The holes 23 formed at small intervals make it possible to more evenly supply the coating solution in the coating width direction, thereby improving the uniformity of an applied film. However, the structure including the small holes 23 may be clogged with foreign matters and a coating solution that have been modified into solid matters. Hence, as illustrated in FIG. 12B, a slit 24 extended with a length of 30 μm to 300 μm in the coating width direction may be effectively used as the liquid outlet port 22 instead of the small holes 23 in FIG. 12A. Even if foreign matters are caught by the slit, this structure can stably supply the solution in the coating width direction without substantially affecting the thickness of the coating film.

What is claimed is:

1. A coating apparatus that applies a coating solution to a coating object, the coating apparatus comprising:

a porous material adopted to contact the coating object to apply the coating solution, and the porous material comprising a receiving region and a contacting region, wherein the receiving region has a receiving end from which the porous material receives the coating solution, and the contacting region has a contacting end from which the porous material applies the coating solution to the coating object;

a conveyor that provides a relative movement between the coating object and the porous material; and a liquid supply nozzle that supplies the coating solution to the receiving end of the receiving region of the porous material, wherein a bubble diameter of all bubbles of the contacting region is larger than a bubble diameter of all bubbles of the receiving region.

2. The coating apparatus according to claim 1, wherein the liquid supply nozzle supplies the coating solution from a plurality of holes arranged in parallel with a width of a surface of the coating object to be coated.

3. The coating apparatus according to claim 1, wherein the liquid supply nozzle supplies the coating solution from a slit extended in parallel with a width of a surface of the coating object to be coated.

4. The coating apparatus according to claim 1, wherein the receiving region of the porous material comprises a first porous material, and the contacting region of the porous material comprises a second porous material that is different from the first porous material, and the second porous material adopted to contact with the coating object.

5. The coating apparatus according to claim 1, further comprising a pair of metal plates holding the porous material, wherein the receiving region of the porous material is compressed by the metal plates.

6. The coating apparatus according to claim 1, wherein the contacting end of the contacting region of the porous material has a tapered end adopted to contact with the coating object.

7. The coating apparatus according to claim 1, wherein the porous material having the receiving region and the contacting region is one sheet.

8. The coating apparatus according to claim 1, wherein the porous material comprises a first sheet having the receiving region and a second sheet having the contacting region.

* * * * *